US010124624B2

(12) United States Patent
Gringer et al.

(10) Patent No.: US 10,124,624 B2
(45) Date of Patent: Nov. 13, 2018

(54) CONTAINER WITH ATTACHMENT

(71) Applicant: ALLWAY TOOLS, INC., W. Babylon, NY (US)

(72) Inventors: Donald Gringer, New York, NY (US); Yuan Fang Cheng, Syosset, NY (US)

(73) Assignee: Allway Tools, Inc., West Babylon, NY (US)

( * ) Notice: Subject to any disclaimer, the term of this patent is extended or adjusted under 35 U.S.C. 154(b) by 0 days.

(21) Appl. No.: 15/675,965

(22) Filed: Aug. 14, 2017

(65) Prior Publication Data

US 2018/0043732 A1 Feb. 15, 2018

Related U.S. Application Data

(60) Provisional application No. 62/374,170, filed on Aug. 12, 2016.

(51) Int. Cl.

| | |
|---|---|
| ***B44D 3/12*** | (2006.01) |
| ***B65D 25/28*** | (2006.01) |
| ***B05C 11/10*** | (2006.01) |

(52) U.S. Cl.

CPC ..... *B44D 3/123* (2013.01); *B05C 11/10* (2013.01); *B65D 25/2829* (2013.01)

(58) Field of Classification Search

CPC ..... B44D 3/123; B44D 3/12; B44D 3/121; B65D 25/2829; B65D 25/2802; B65D 25/28; B05C 11/10

USPC ..... 220/756, 763, 762, 759, 736, 735, 769, 220/700, 701, 699, 697, 570; 248/683, 248/206.5, 205.1, 309.4; D32/53.1; D9/906; 16/234

See application file for complete search history.

(56) References Cited

U.S. PATENT DOCUMENTS

| | | | | | |
|---|---|---|---|---|---|
| 1,024,841 | A * | 4/1912 | Emery | A47K 1/09 | 211/66 |
| 1,698,403 | A * | 1/1929 | Harris | B44D 3/14 | 16/425 |
| 1,863,138 | A * | 6/1932 | Le Sauvage | A47J 47/18 | 220/763 |
| 1,865,283 | A * | 6/1932 | Sohnle | B44D 3/123 | 220/735 |
| 2,150,965 | A * | 3/1939 | Doty | B44D 3/128 | 220/571.1 |
| 2,184,460 | A * | 12/1939 | Linder | B44D 3/123 | 220/736 |
| 2,540,860 | A * | 2/1951 | Blomquist | B44D 3/123 | 15/257.01 |

(Continued)

OTHER PUBLICATIONS

Bercom; Handy Paint Products, Handy Paint Pail, www.handypaintproducts.com, Dec. 10, 2014.

*Primary Examiner* — Robert J Hicks

(74) *Attorney, Agent, or Firm* — Gottlieb, Rackman & Reisman, P.C.

(57) ABSTRACT

A paint container that includes a bracket that is rotatably fixed to the container and is configured to allow an object (e.g., paint brush) to be releasably fixed thereto. The bracket can include a first bracket member and a second bracket member that extends at an angle from the first bracket member. The bracket is fixed to the container such that the bracket is rotatable to at least partially extending within the interior of the container and to fully extend above the container. At least one magnet can fixed to the bracket to secure the object thereto.

20 Claims, 20 Drawing Sheets

(56) References Cited

U.S. PATENT DOCUMENTS 2,661,858 A * 12/1953 Howell ..... B44D 3/126 15/104.001
3,729,158 A * 4/1973 Nagy ..... B44D 3/123 248/110
3,756,451 A * 9/1973 Popeil ..... A47J 47/18 15/264
4,023,702 A * 5/1977 McKnight ..... B44D 3/14 15/257.06
4,993,767 A * 2/1991 Song ..... A47J 45/10 220/736
4,995,526 A * 2/1991 Garrison ..... A47J 47/18 15/264
5,816,549 A * 10/1998 Anderson ..... B44D 3/123 248/213.2
6,491,271 B1 * 12/2002 Adams ..... A47G 1/17 248/206.5
6,708,838 B2 3/2004 Bergman et al.
6,991,829 B2 1/2006 Bergman
7,644,835 B2 1/2010 Bergman
D617,517 S 6/2010 Bergman
8,550,285 B2 10/2013 Bergman et al.
8,556,116 B2 10/2013 Bergman et al.
8,844,749 B2 * 9/2014 Manahan ..... H02B 1/28 220/324
8,919,604 B2 12/2014 Bergman et al.
9,409,200 B2 8/2016 Bergman et al.
2006/0175362 A1 * 8/2006 Gringer ..... B44D 3/127 222/570
2015/0034777 A1 * 2/2015 Ionis ..... B44D 3/123 248/113
2017/0007012 A1 * 1/2017 Aide ..... A46B 15/0095
2017/0129277 A1 * 5/2017 Rogowski ..... B44D 3/14
2017/0253379 A1 * 9/2017 Wangler ..... B65D 25/2829

* cited by examiner

CONTAINER WITH ATTACHMENT

This patent application claims benefit under 35 U.S.C. § 119 to U.S. Provisional Patent Application No. 62/374,170, filed Aug. 12, 2016, which is hereby incorporated by reference in its entirety as part of the present disclosure.

FIELD OF THE INVENTION

The invention generally relates to containers and more specifically to a container that has a rotatable attachment for holding an object (e.g., paint brush) at least partially within or above the container.

BACKGROUND OF THE INVENTION

Various containers exist to hold, for example, paint, stain or the like. At least some of these containers include structures to hold an object at a fixed position within the container.

U.S. Pat. No. 8,919,604, for example, discloses a container designed to house paint therein that includes at least one magnet fixed to an inner wall of the container. The patent is designed for the ferrule of a paint brush to be releasably connected to the magnet to allow paint to drip from the bristles of the brush into the container. However, the scope of use of the magnet in connection with the container is limited. For example, depending on the depth of paint in the container, if desired, the brush may be submerged in paint and therefore be precluded from allowing paint to drip from the brush into the container. Additionally, a user may not wish to releasably fix a brush only in a substantially vertical position in relation to the container sidewall.

SUMMARY OF THE INVENTION

The present invention is directed to a container that includes a handle that is fixable to the container base and a bracket that is rotatably fixed to and can extend into the container and allows for an object (e.g., a paint brush) to be connectable thereto.

The container includes a base, a sidewall extending from the periphery of the base, a handle that is fixed at one end to the container and fixable at a second end to the base of the container and a bracket that is rotatably fixed to the container, near the second end of the handle.

In an embodiment, the bracket includes a first bracket member, a second bracket member that extends from a first end of the first bracket member at an angle, connecting elements that extend from a second end of the first member and at least one component that is configured to create a connection with another object fixed to the second member of the bracket. In an embodiment, the at least one component fixed to the second bracket member are magnetic.

The bracket is configured such that the second member can be orientated to be arranged substantially parallel to the sidewall of the bucket and within an upper region of the bucket or at an angle above the upper periphery of the sidewall of the bucket. The bracket is designed for the ferrule of a paint brush to be releasably fixed to the magnets. By configuring the bracket to be rotatable, a user can fix a paint brush to be substantially vertical to the bracket or at an angle in relation to the bucket as desired.

DETAIL DESCRIPTION OF EMBODIMENTS OF THE INVENTION

Figure 1A:
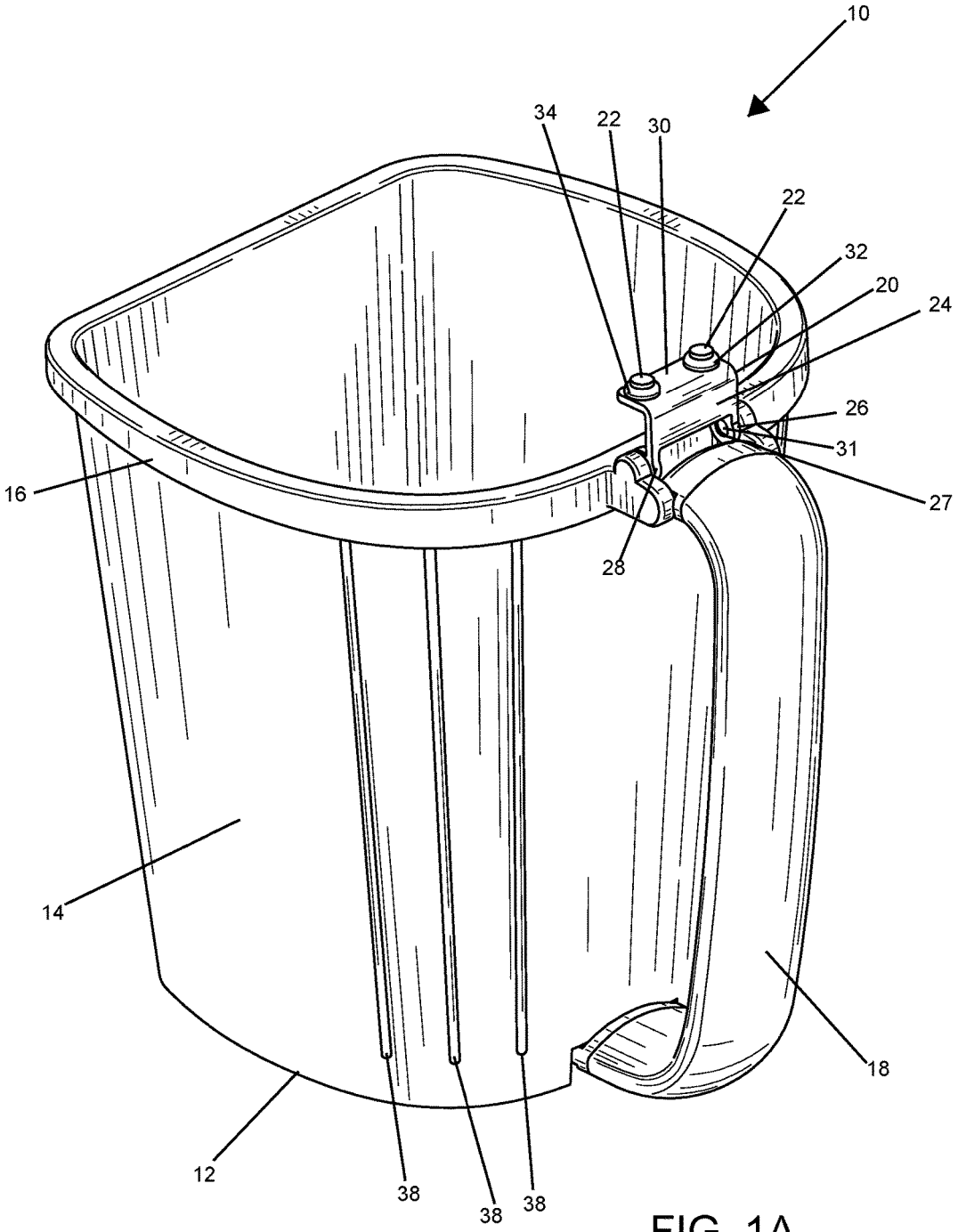
FIG. 1A is a first perspective of an embodiment of the container of the present invention.

With reference now to the drawings, and in particular to FIGS. 1A through 22, embodiments of a container embodying the principles and concepts of the present invention will be described.

As can be seen in FIGS. 1A-10, the container 10 includes a base 12, a sidewall 14 that extends at a first end from the base 12, a rim 16 that extends from and delimits a second end of the sidewall 14, a handle 18 rotatably fixed to the container 10 and a bracket 20 that includes magnets 22 fixed thereto rotatably fixed to the container 10.

As illustrated in FIG. 1A, the bracket 20 is substantially L-shaped and includes a first bracket member 24, a first flange 26 and a second flange 28 that extend from the first bracket member 24 and are configured to rotatably fix the bracket 20 to the container 10, a second bracket member 30 that extends at an angle (about 90 degrees) from a second end of the first bracket member 24, a first housing 32 and a second housing 34 that both extend from a first surface 36 of the second bracket member 30 and are configured to receive the magnets 22. The flanges 26, 28 include openings 27, 29, respectively, that interact with projections 31, 33, respectively, which extend from the container 10 (see FIGS. 3 and 4). The interaction of the flanges 26, 28/openings 27, 29 with the projections 31, 33 allows the bracket 20 to rotate at a plurality of angles about the container 10. Similarly, the handle 18 is rotatable about projections 35, 37 that are spaced from the projections 31, 33 on which the bracket 20 is rotatably fixed. In addition to allowing for multiple positions of the handle 18 during use of the container 10, by pivoting the handle 18 a plurality of containers 10 can be stacked in one plane on top of each other to reduce the footprint needed during shipping and to allow for less space to be required at a retail location to display the container 10.

Figure 1B:
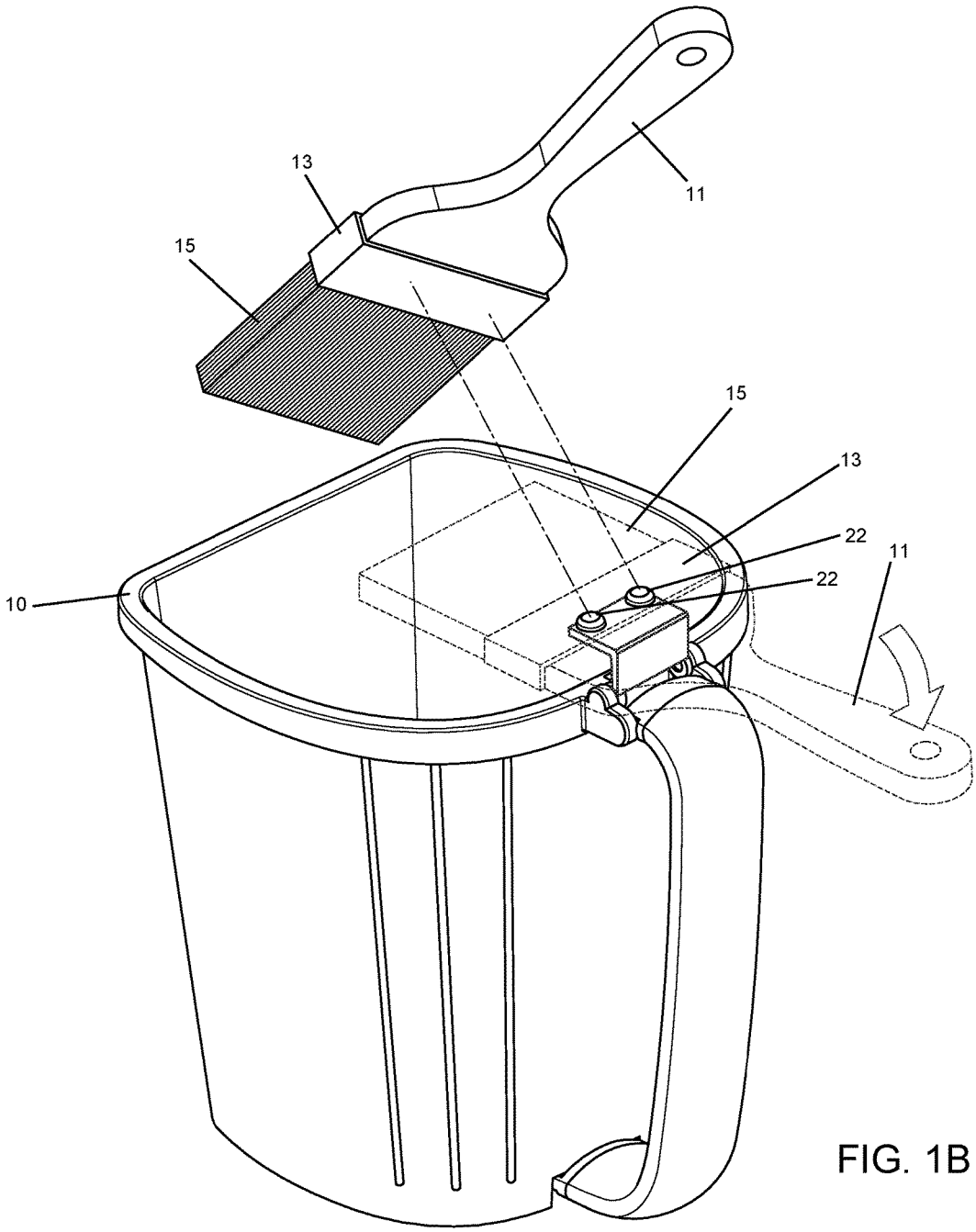
FIG. 1B shows a paint brush spaced from and attachable to a bracket of the container.
Figure 1C:
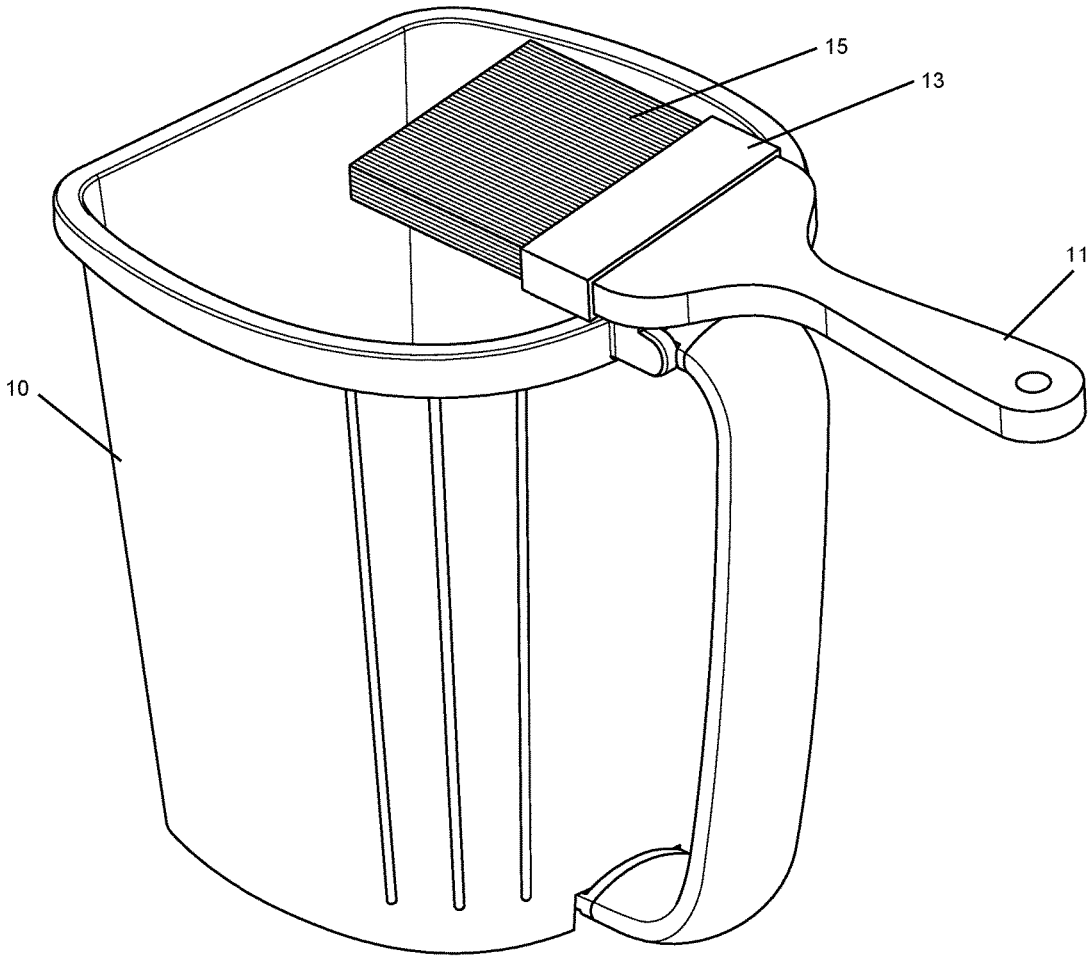
FIG. 1C shows the paint brush attached to a bracket such that the paint brush is substantially perpendicular to the interior of the container.
Figure 2A:
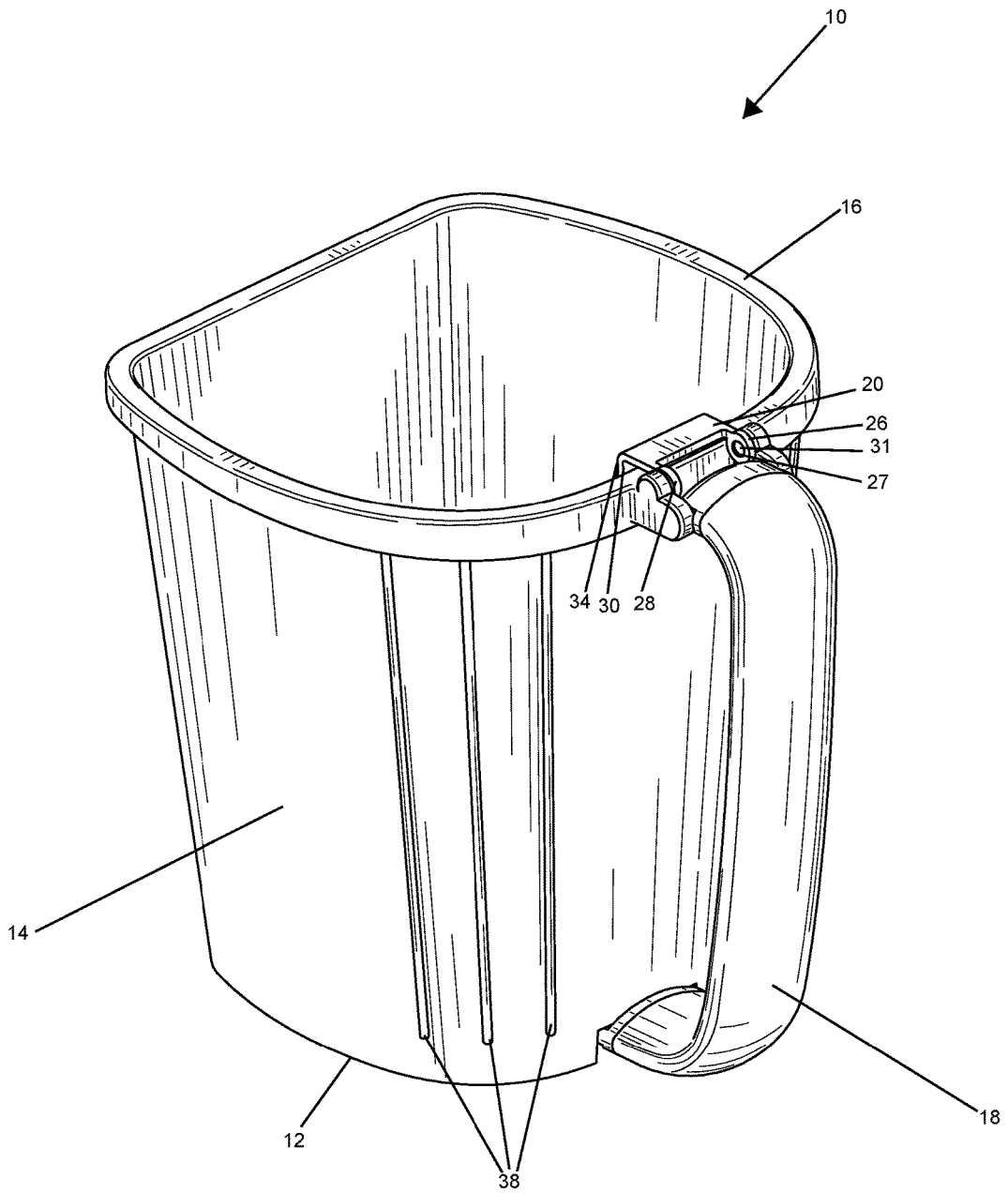
FIG. 2A is a second perspective view of the container of FIG. 1 with the bracket articulated into the interior of the container.
Figure 2B:
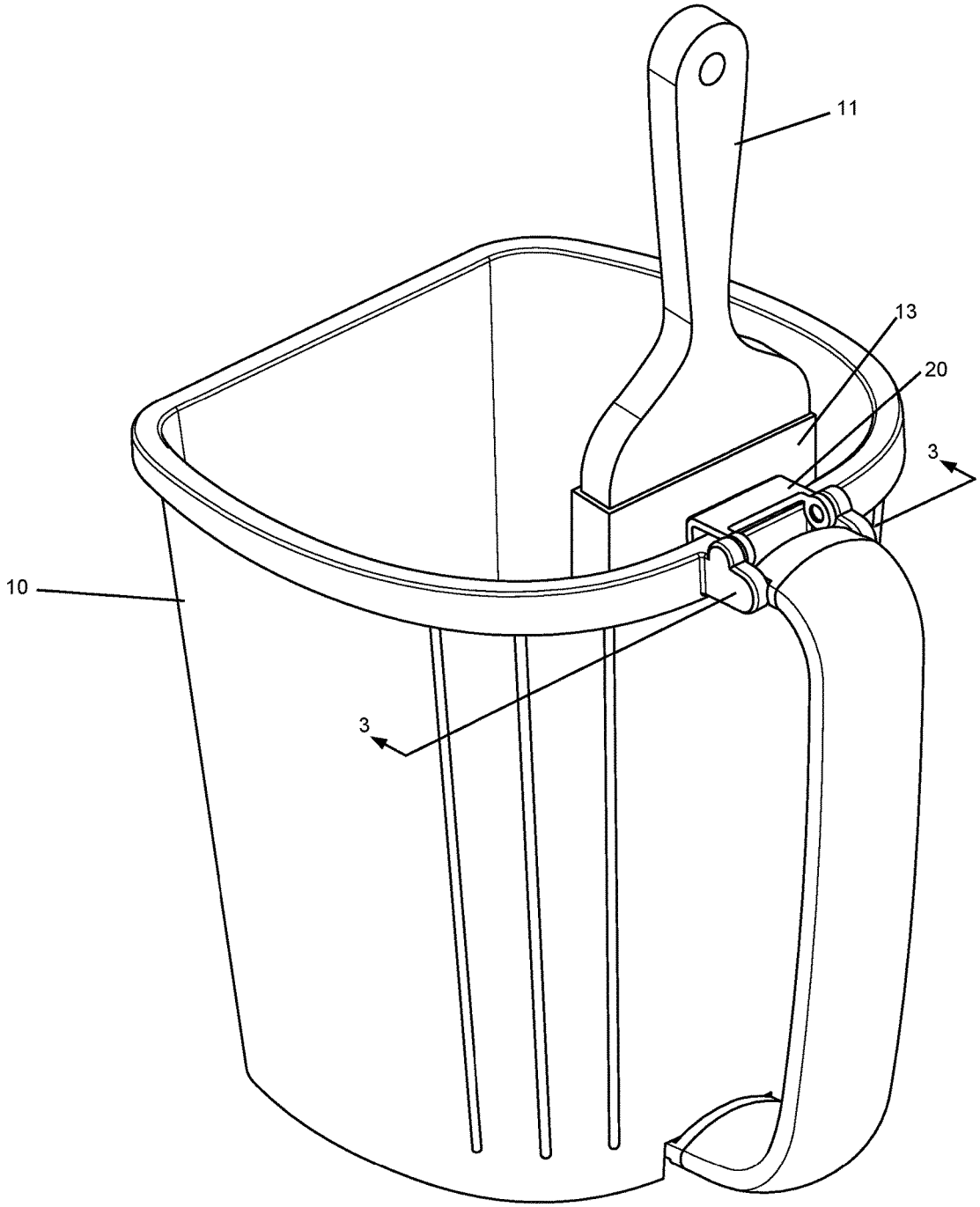
FIG. 2B is the perspective view of FIG. 2A with a paint brush attached to the bracket such that at least the bristles of the paint brush extends into the container.
Figure 3:
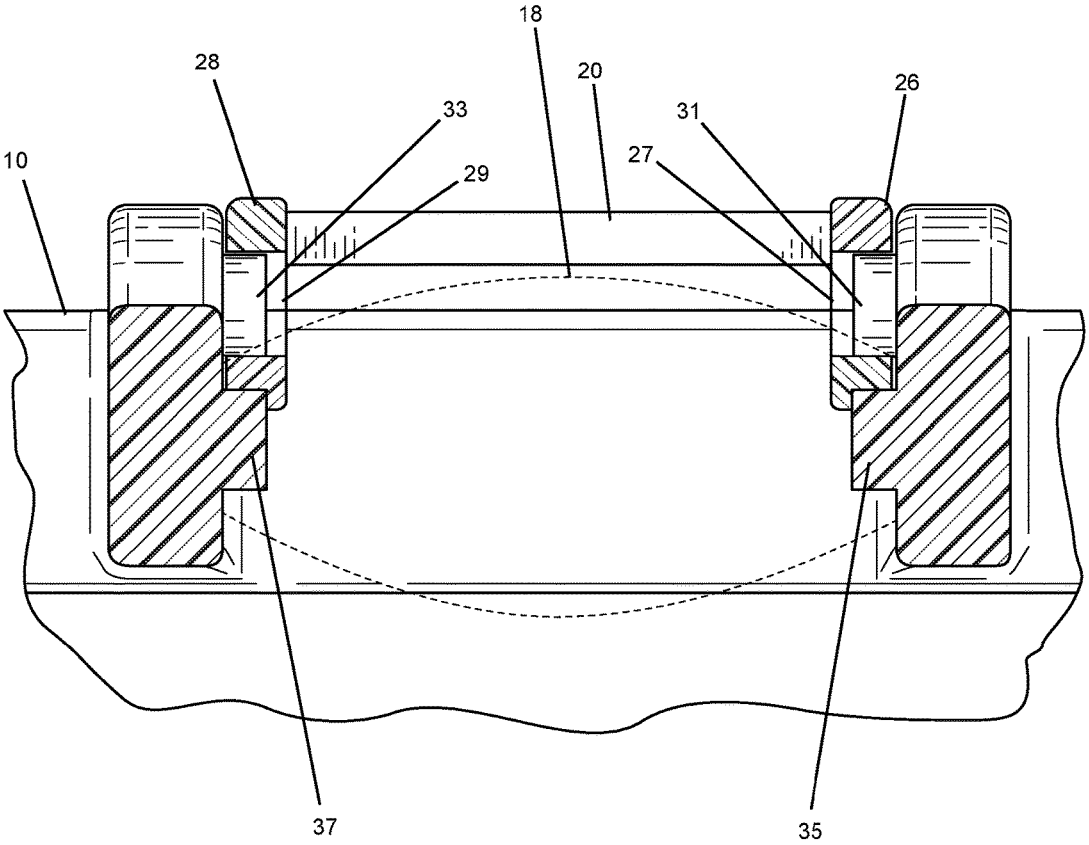
FIG. 3 is a cross-sectional view of FIG. 2B showing the connection between the bracket and handle to the container body.
Figure 4:
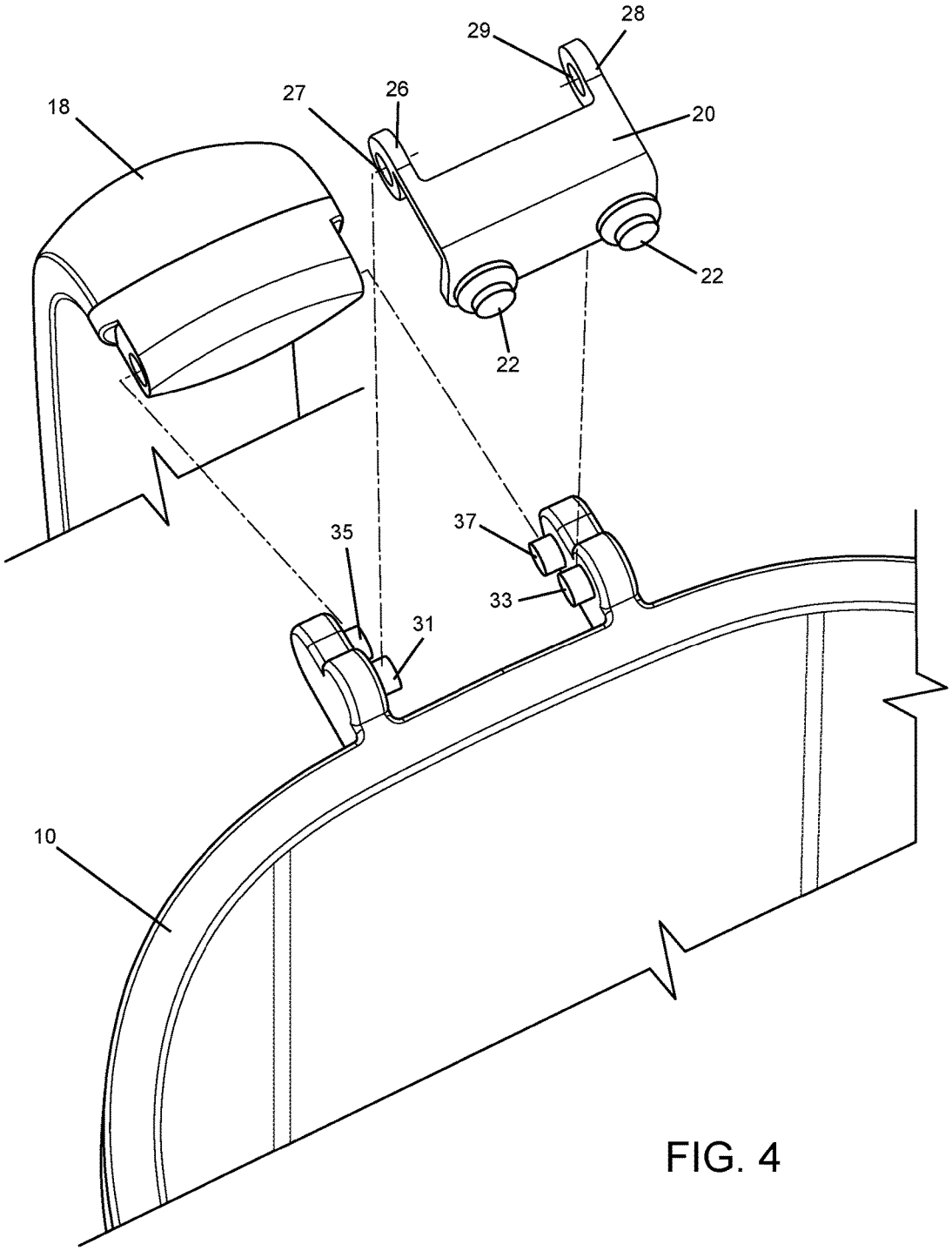
FIG. 4 is a partially exploded view of the container showing the features connecting the bracket and handle to the container body.

FIG. 1A shows the bracket 20 rotated such that the second bracket member 30 and housings 34, 36 and magnets 22 that are arranged within the housings 34, 36 are arranged above the rim 16 of the container 10. In this configuration, an object, for example a paint brush 11 as shown in FIGS. 1B and 1C, can be releasably fixed to the bracket 20 by a ferrule 13 of the paint brush 11 entirely outside of the interior of the container 10. As shown in FIG. 1C, the paint brush 11 is orientated substantially transverse to the interior of the container 10. In this configuration, a user may, for example, fix the paint brush 11 to the bracket 20 to allow paint to drip off of the brush and into the container 10 or may fix the paint brush 11 to the bracket 20 after cleaning the paint brush 11 to dry. Regardless of orientation of the bracket 20, the ferrule 13 of the paint brush 11 is in direct contact with at least the magnets 22 such that the paint brush 11 is releasably fixed to the container 10 and spaced from the bracket 20 by the length or depth of the magnets 22.

FIGS. 2A-9 show the bracket 20 rotated such that the second bracket member 30 and magnets 22 extend into the interior of the container 10. As shown, the second bracket member 30 and magnets 22 are orientated substantially parallel to the sidewall 14 of the container 10. In this configuration, for example as shown in FIG. 2B, a user could releasably attach the paint brush 11 by the ferrule 13 of the brush 11 to the magnets 22 to allow the bristles 15 of the brush 11 to be at least partially submerged within paint in the container 10 or if the level of paint in the container 10 is low enough, the brush 11 can be attached to the bracket 20 to allow paint to drip off of the bristles 15 and into the container 10.

Although the bracket 20 is shown as substantially L-shaped, the bracket 20 can take on any shape that allows for the bracket 20 to be configured at various positions or angles of orientation within and above the container 10. Also, as shown in the figures, the bracket 20 includes two magnets 22. However, any number of magnets 22 can be fixed to the bracket 20. Alternatively, another element can be fixed to the bracket 20 to allow an object to be releasably fixed thereto.

Figure 5:
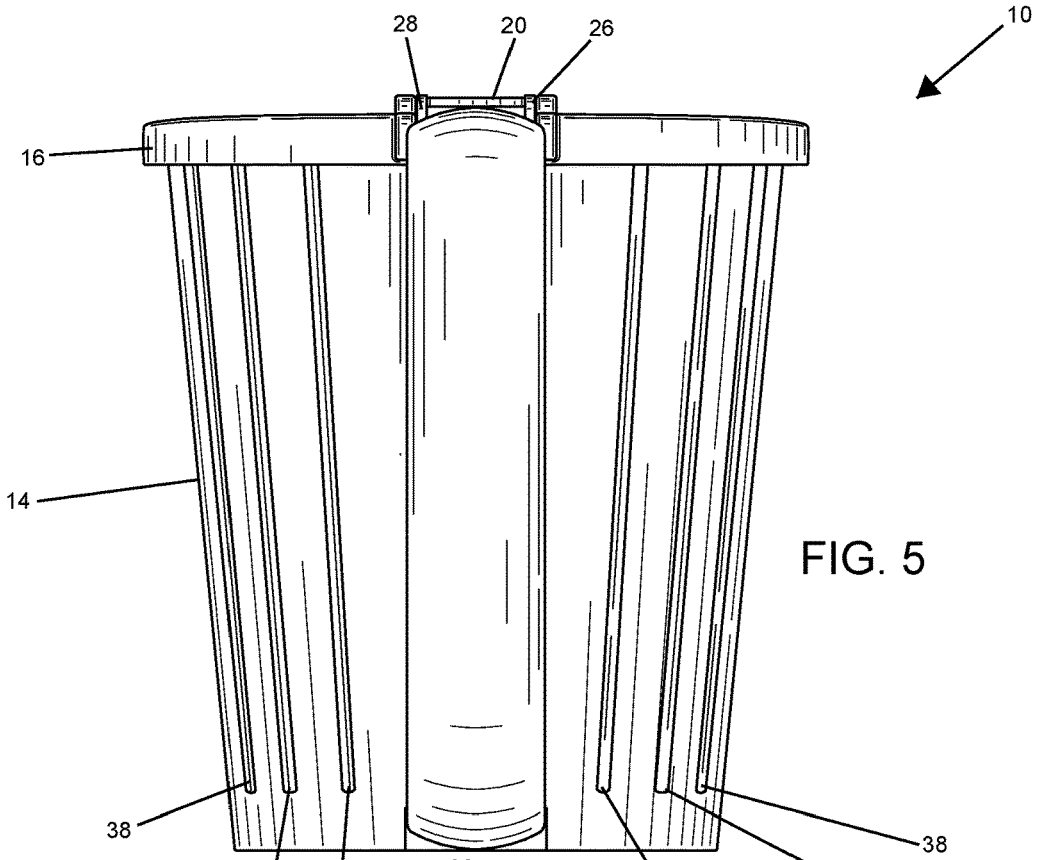
FIG. 5 is a rear view of the container.
Figure 6:
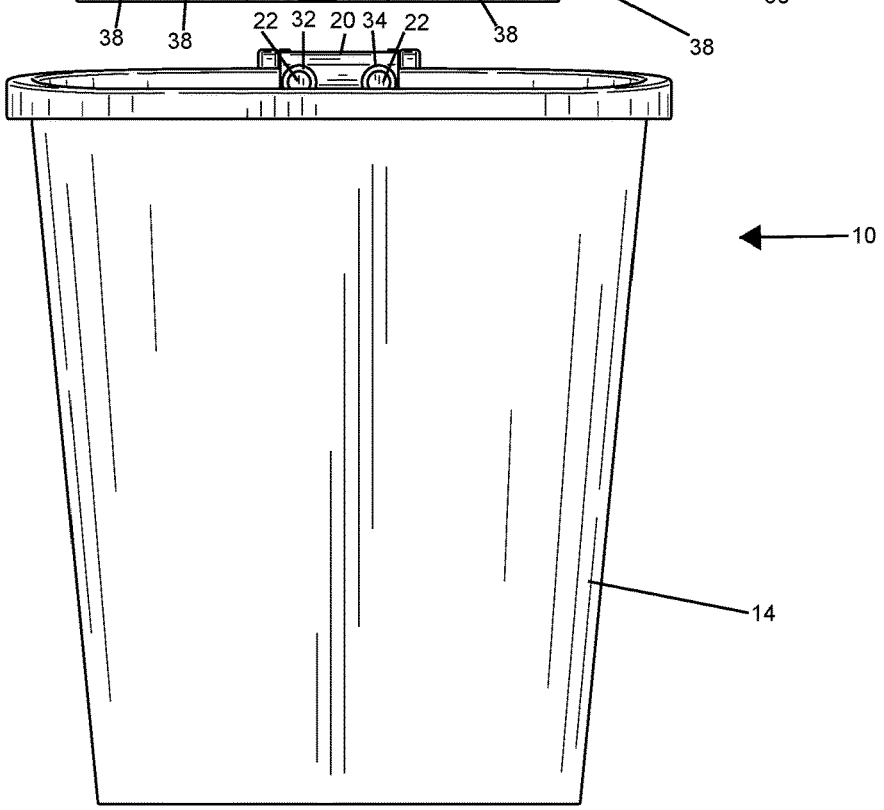
FIG. 6 is a front view of the container.
Figure 7:
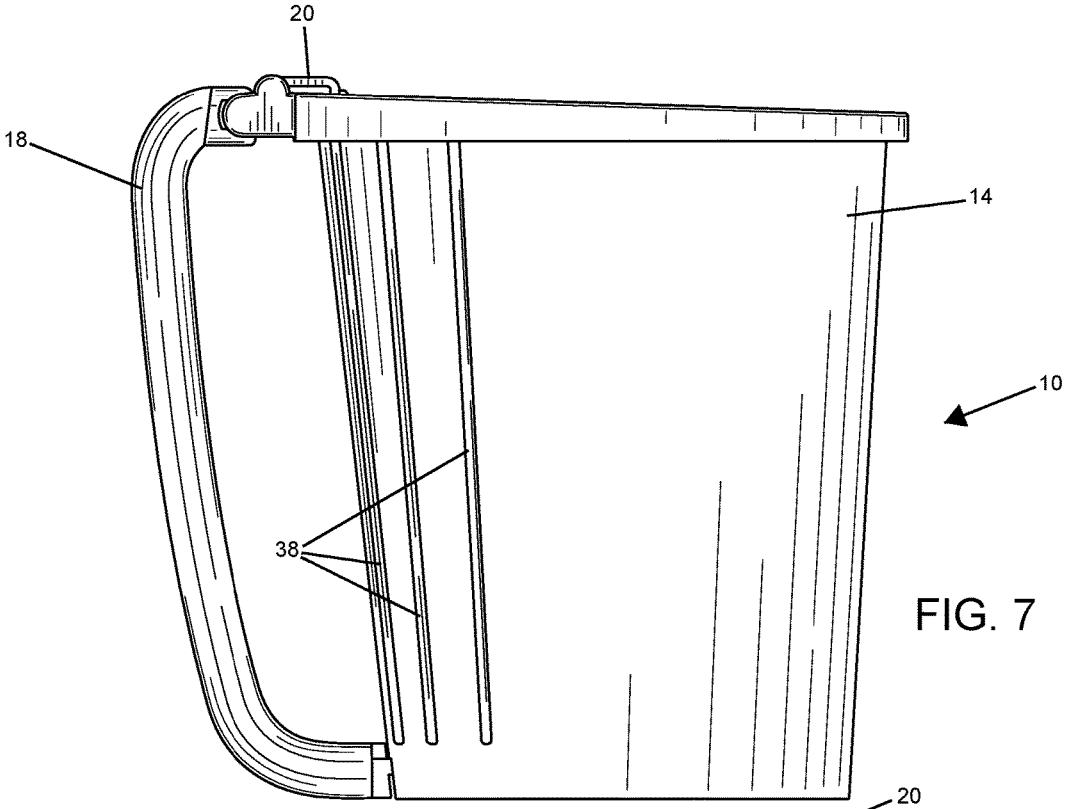
FIG. 7 is a first side view of the container.
Figure 8:
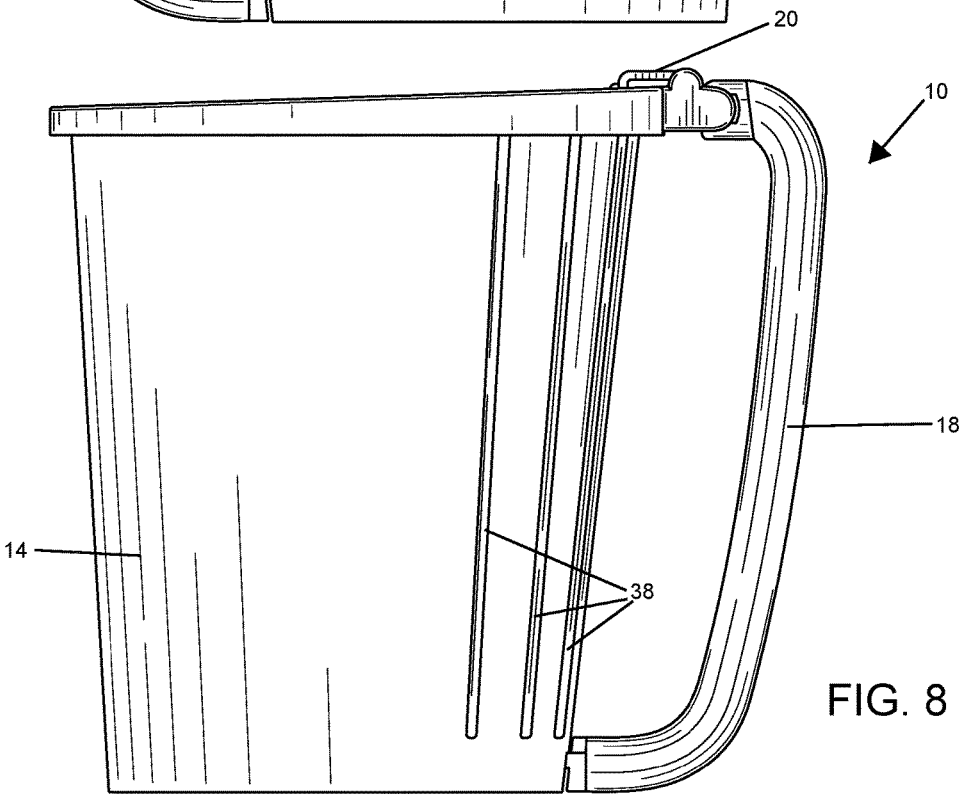
FIG. 8 is a second side view of the container.
Figure 9:
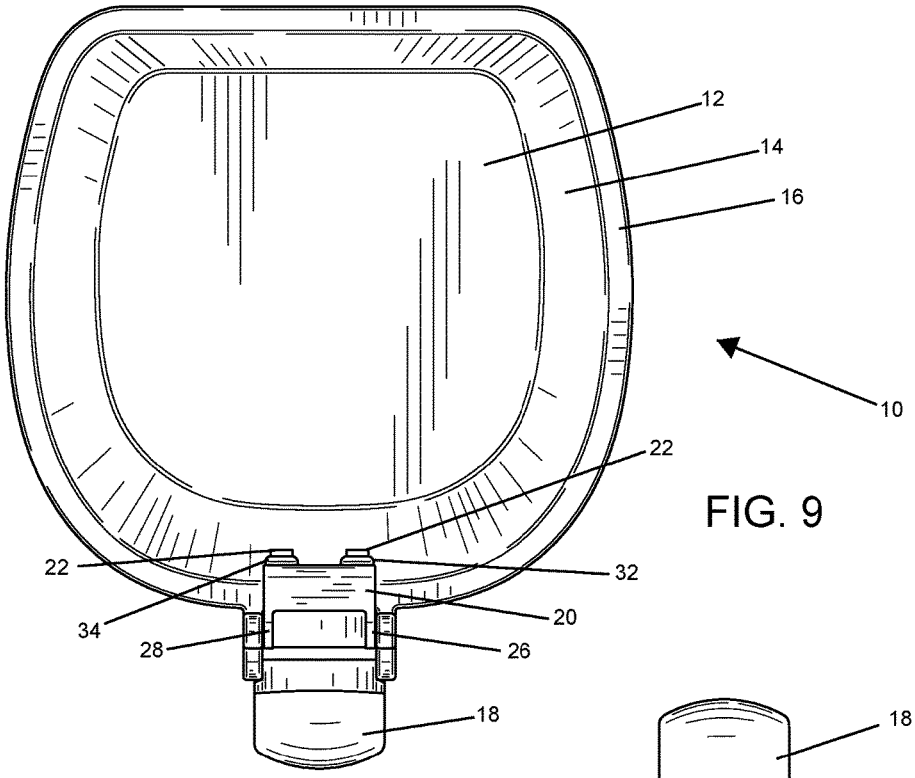
FIG. 9 is a top view of the container.
Figure 10:
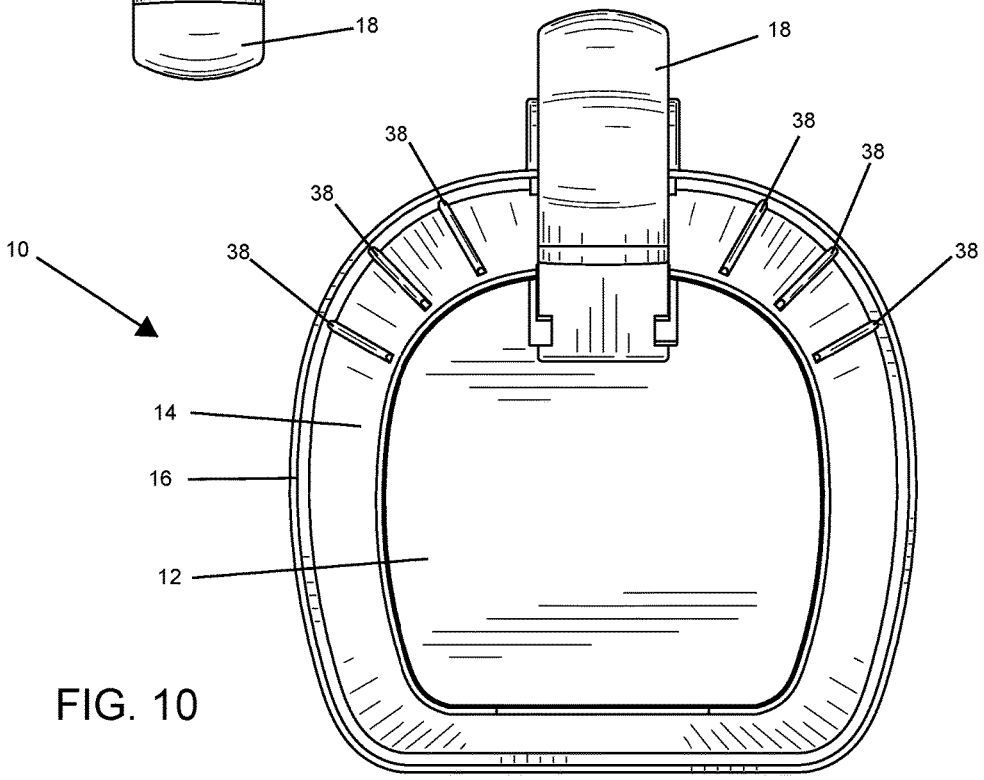
FIG. 10 is a bottom view of the container.

Additionally, can be seen, for example, in the rear view of FIG. 5, the container 10 includes a plurality of linearly extending strips 38 that extend outwardly from the sidewall 14 of the container 10 at a first location to the right of the handle 18 and at a second location to the left of the handle 18. Should a user slide their hand between the handle and container 10 instead of gripping the handle 18, the strips 38 aid the user in gripping the container 10. This is particularly helpful when a liquid may be drip onto the exterior of the container 10 and cause the container 10 to be slippery.

FIGS. 11A-22 depict a second embodiment of the present invention. As can be seen in, a container 100 includes a base 112, a sidewall 114 that extends at a first end from the base 112, a rim 116 that extends from and delimits a second end of the sidewall 114, a handle 118 rotatably fixed to the container 100 and a bracket 120 that includes a plurality of magnets 122 fixed thereto rotatably fixed to the container 100.

The bracket 120 is substantially L-shaped and includes a first bracket member 124, a first flange 126 and a second flange 128 that extend from the first bracket member 124 and are configured to rotatably fix the bracket 120 to the container 100, a second bracket member 130 that extends at an angle (about 90 degrees) from a second end of the first bracket member 124, a first housing 132 and a second housing 134 that both extend from a first surface 136 of the second bracket member 130 and are configured to receive the magnets 122. The flanges 126, 128 include openings 127, 129, respectively, that interact with projections 131, 133, respectively, which extend from the container 100 (see FIGS. 14 and 16). The interaction of the flanges 126, 128/openings 127, 129 with the projections 131, 133 allows the bracket 120 to rotate at a plurality of angles about the container 100. Similarly, the handle 118 is rotatable about projections 135, 137 that are spaced from the projections 131, 133 on which the bracket 120 is rotatably fixed. In addition to allowing for multiple positions of the handle 118 during use of the container 100, by pivoting the handle 118 a plurality of containers 100 can be stacked in one plane on top of each other to reduce the footprint needed during shipping and to allow for less space to be required at a retail location to display the container 100.

Figure 11A:
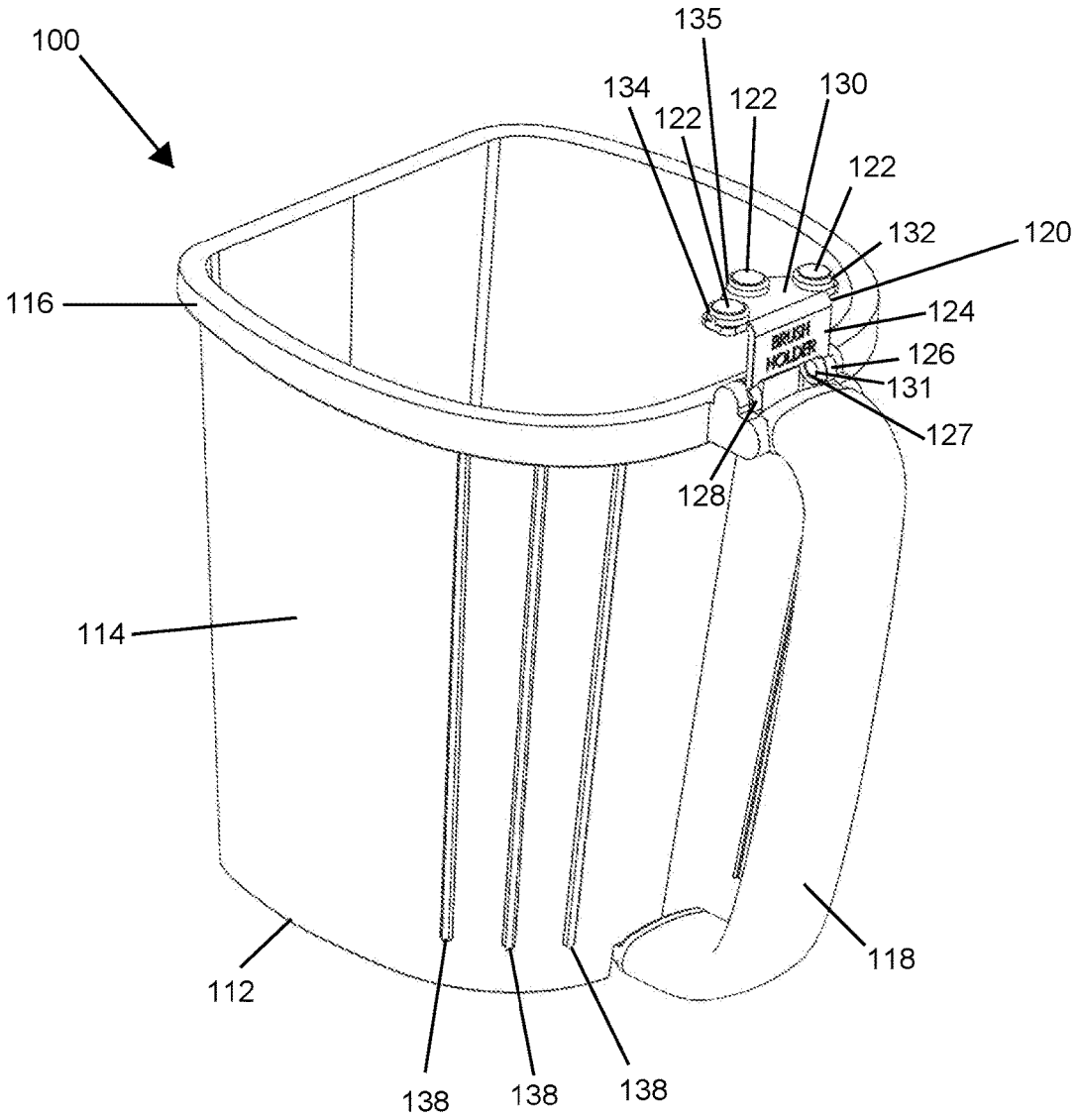
FIGS. 11A-11C are perspective views of a second embodiment of a container of the present invention with a bracket that includes magnets fixed thereto rotated at least partially out of the interior of the container.
Figure 11B:
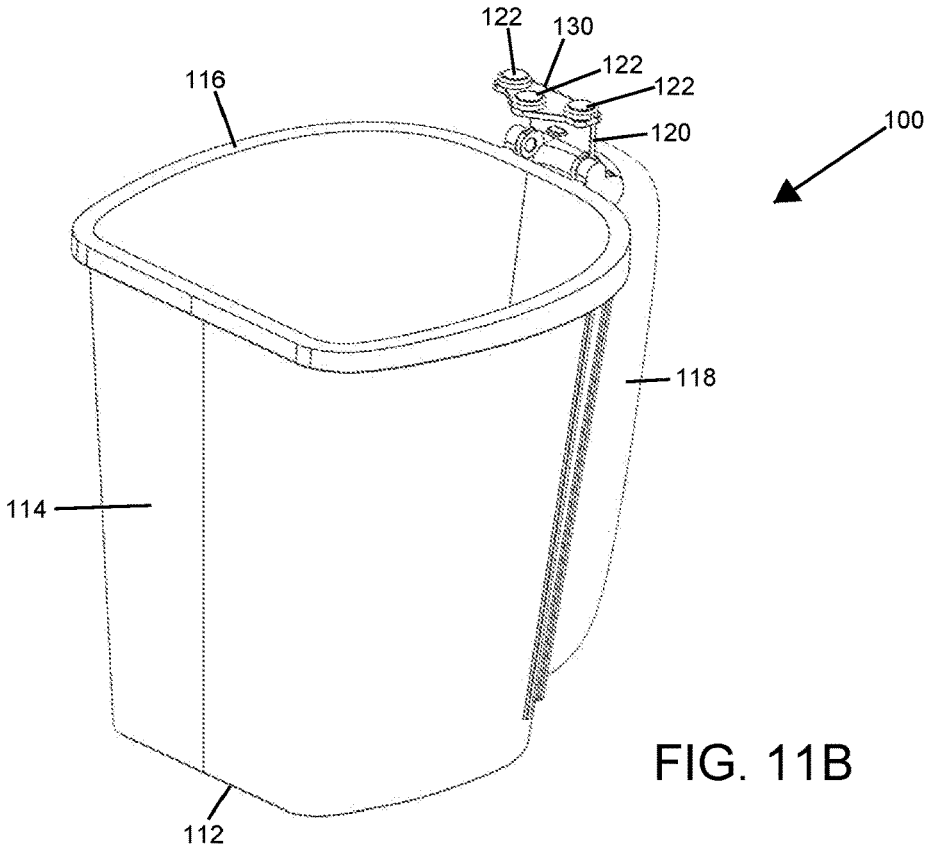
Figure 11C:
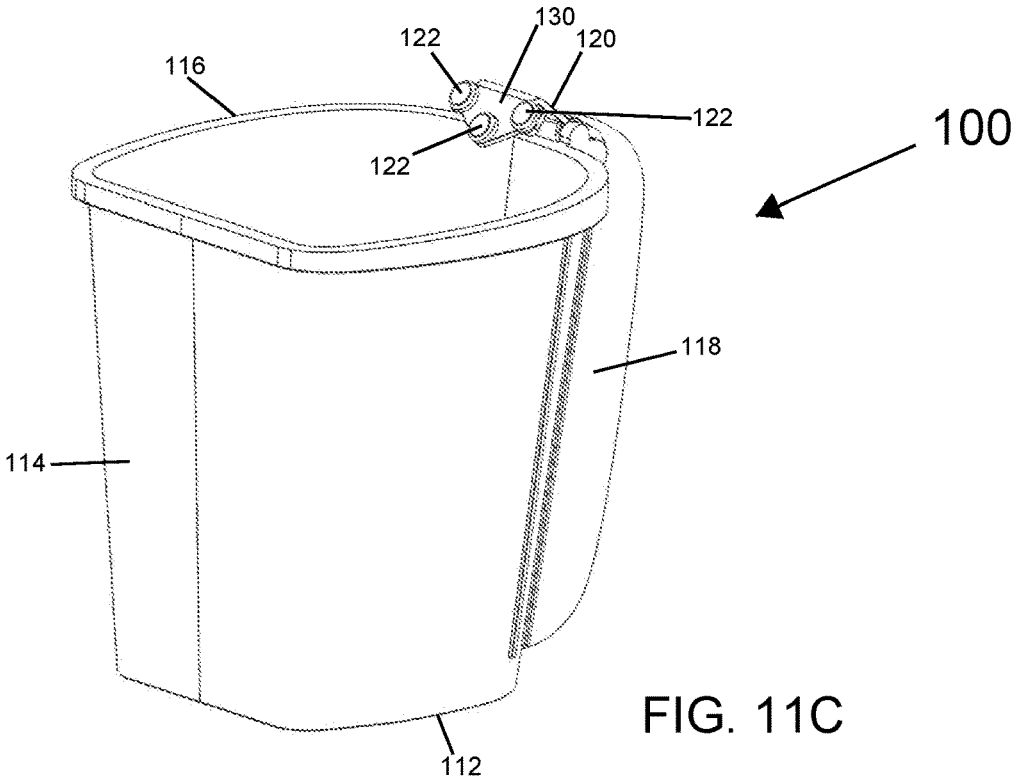
Figure 12A:
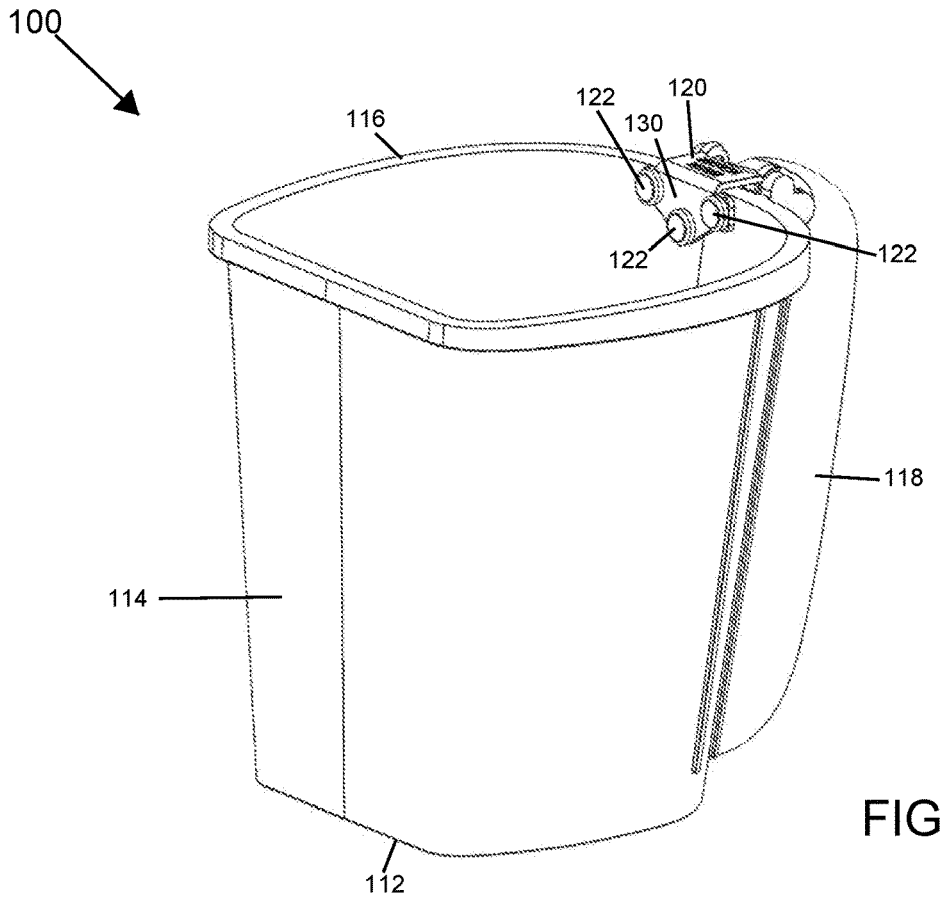
FIGS. 12A and 12B are perspective views of the second embodiment of the container of the present invention with a bracket that includes magnets fixed thereto rotated into the container body.
Figure 12B:
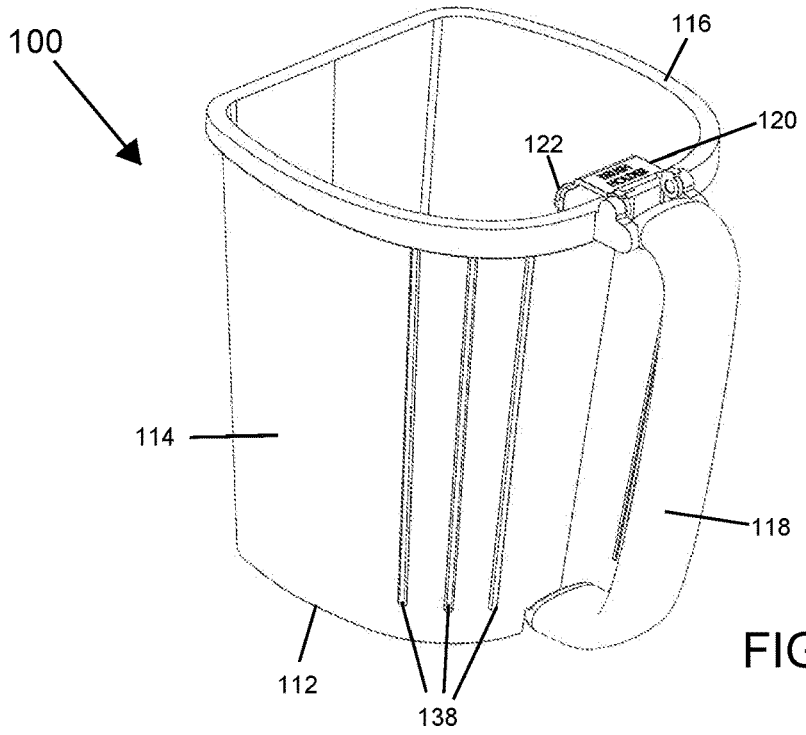
Figure 13:
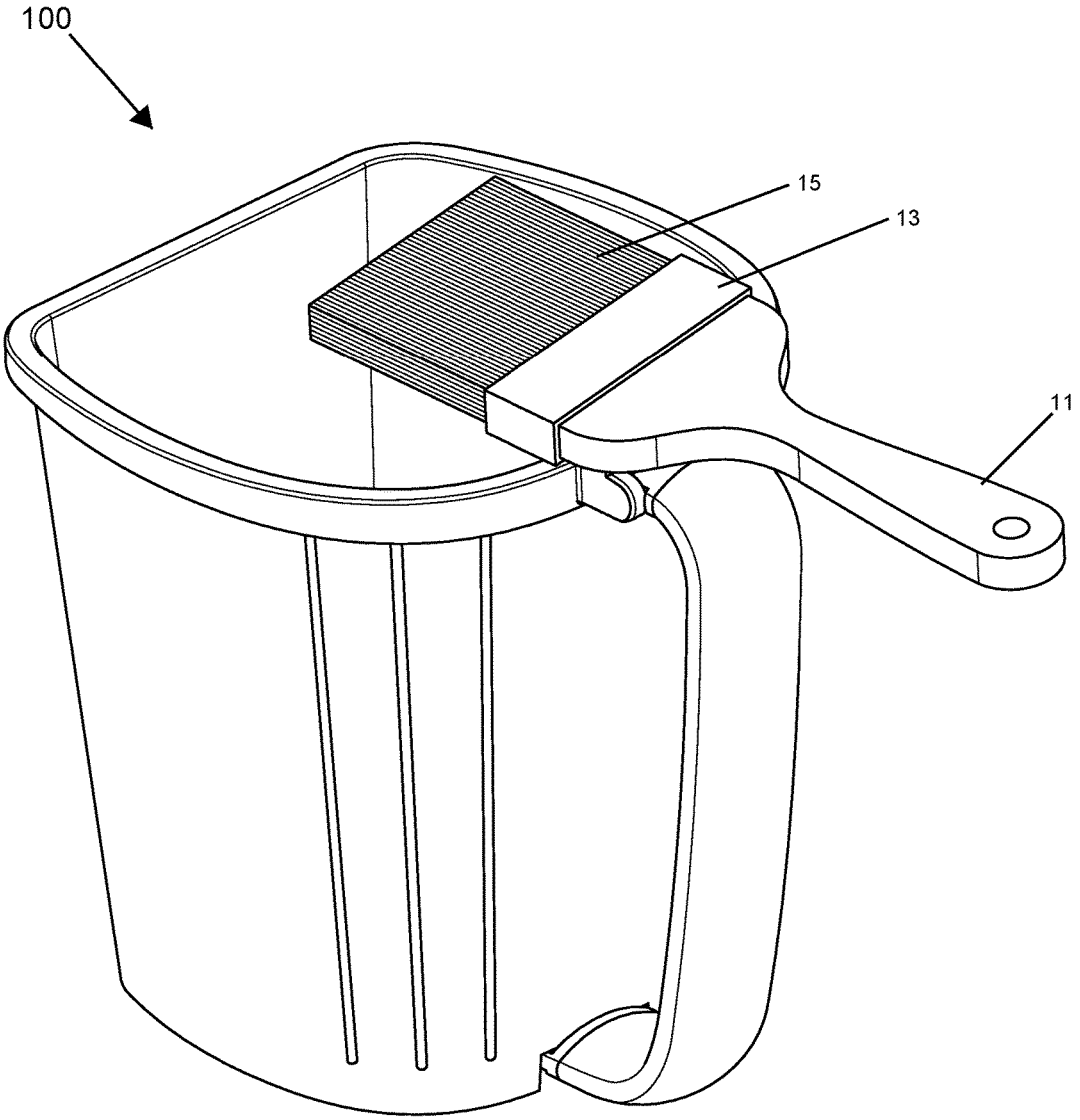
FIG. 13 shows a paint brush attached to the bracket of the second embodiment such that the paint brush is substantially perpendicular to the interior of the container.

FIGS. 11A-11C shows the bracket 120 rotated such that the second bracket member 130 and in turn magnets 122 are arranged above the rim 116 of the container 100. In this configuration, an object, for example a paint brush 11 as shown in FIG. 13, can be releasably fixed to the bracket 120 by a ferrule 13 of the paint brush 11 entirely outside of the interior of the container 100. As shown in FIG. 13, the paint brush 11 is orientated substantially transverse to the interior of the container 100. In this configuration, a user may, for example, fix the paint brush 11 to the bracket 120 to allow paint to drip off of the brush and into the container 100 or may fix the paint brush 11 to the bracket 120 after cleaning the paint brush 11 to dry. Regardless of orientation of the bracket 120, the ferrule 13 of the paint brush 11 is in direct contact with at least the magnets 122 such that the paint brush 11 is releasably fixed to the container 100 and spaced from the bracket 120 by the length or depth of the magnets 122.

FIGS. 12A-12B and 17-21 show the bracket 120 rotated such that the second bracket member 130 and magnets 122 extend into the interior of the container 100. As shown, the second bracket member 130 and magnets 122 are orientated substantially parallel to the sidewall 114 of the container 100. In this configuration, a user could releasably attach the paint brush 11 by the ferrule 13 of the brush 11 to the magnets 122 to allow the bristles 15 of the brush 11 to be at least partially submerged within paint in the container 100 or if the level of paint in the container 100 is low enough, the brush 11 can be attached to the bracket 120 to allow paint to drip off of the bristles 15 and into the container 100.

Figure 14:
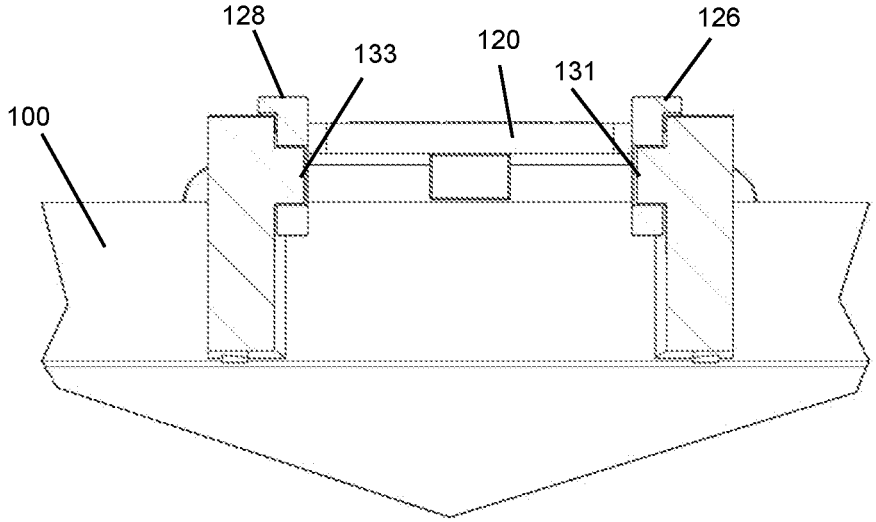
FIG. 14 is a cross-sectional view of the container of the second embodiment showing the connection between the bracket and handle to the container body.

FIG. 14 shows a cross-sectional view of the bracket 120 rotatably fixed via the openings 127, 129 within the flanges 126, 128 thereof with projections 131, 133, respectively, which extend from the container 100.

Figure 15A:
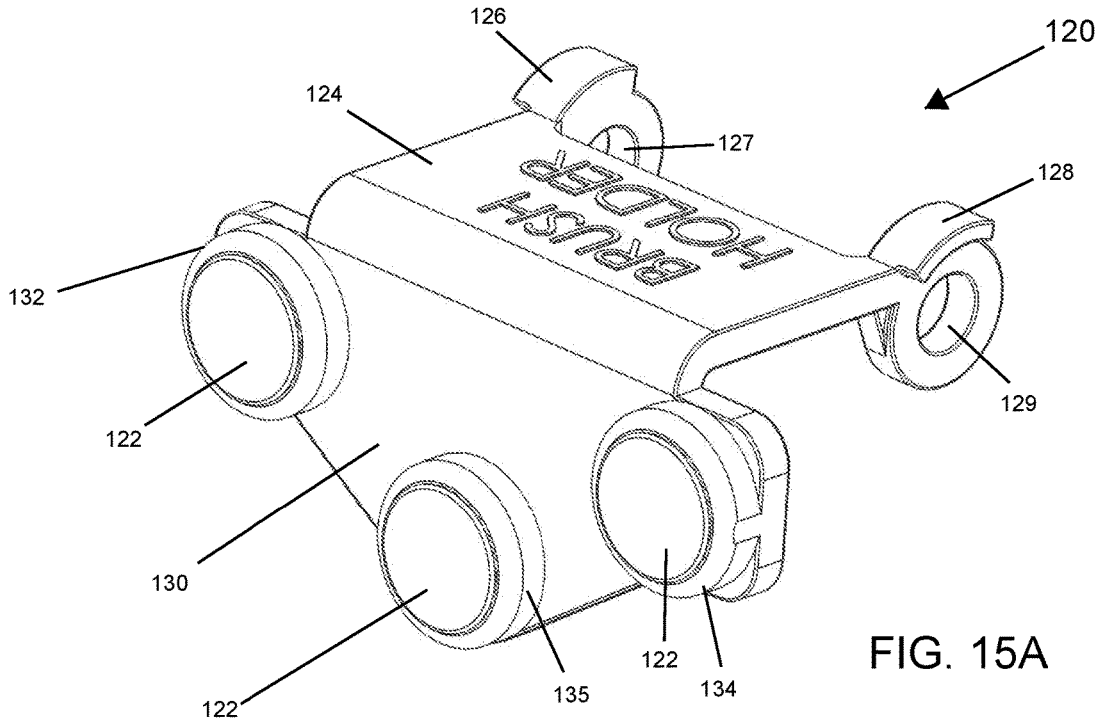
FIG. 15A is a perspective view of the bracket of the second embodiment showing the inclusion of three magnets.
Figure 15B:
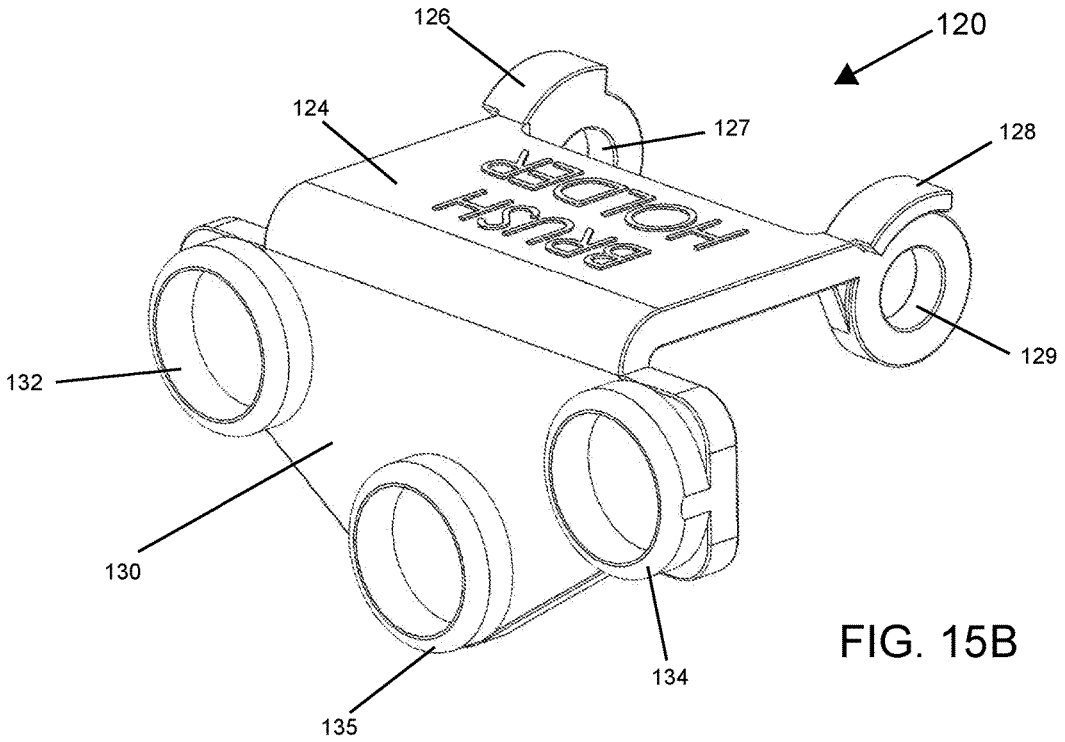
FIG. 15B is a perspective view of the bracket of the second embodiment showing projections in which magnets are arranged.
Figure 16:
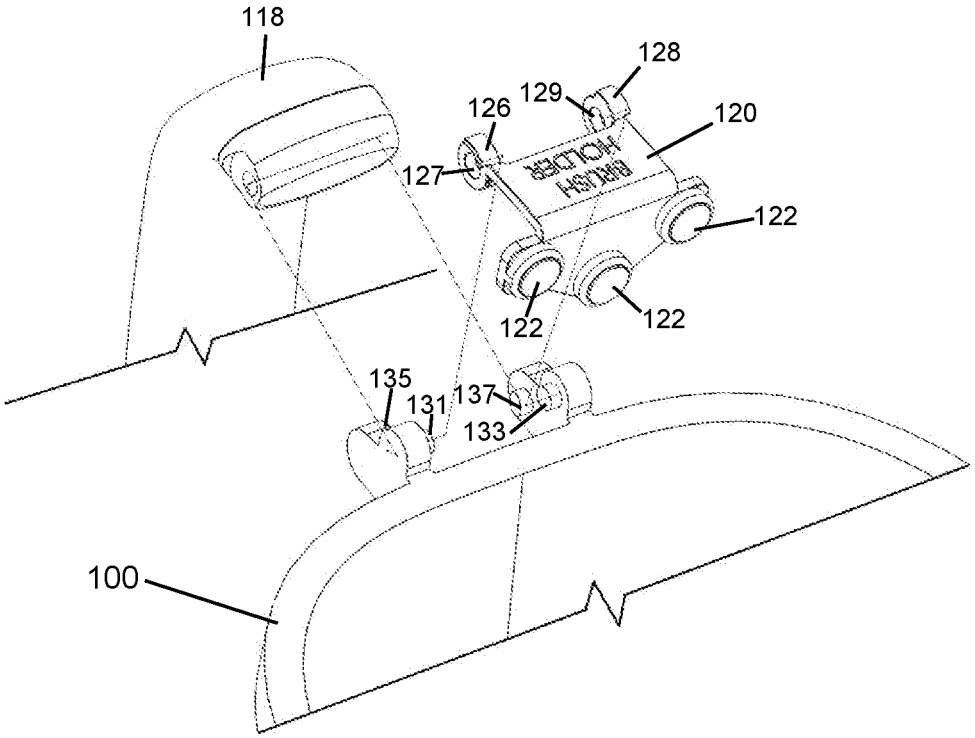
FIG. 16 is a partially exploded view of the container of the second embodiment showing the features connecting the bracket and handle to the container body.

FIG. 15A depicts the bracket 120 with a plurality of magnets 122 fixed thereto and FIG. 15B shows the bracket 120 with the first housing 132, the second housing 134 and third housing 135 that are configured to receive the magnets 122 extending from the first surface 136 of the second bracket member 130. As shown, the second bracket member 130 is triangular with the housings 132, 134, 135 and magnets 122 spaced to be located at the apexes of the triangle. By spacing the magnets 122 as shown, the polarity of the magnets extends across the entire surface area of the second bracket member 130.

Although the bracket 120 is shown as substantially L-shaped and the second bracket member 130 is substantially triangular, the bracket 120 can take on any shape that allows for the bracket 120 to be configured at various positions or angles of orientation within and above the container 100 and/or the second bracket member 130 can take on any shape that can accommodate a plurality of magnets. Although three magnets 122 are shown, any number of magnets 122 can be fixed to the bracket 120. Alternatively, another element can be fixed to the bracket 120 instead of or in addition to magnets to allow an object to be releasably fixed thereto.

Figure 17:
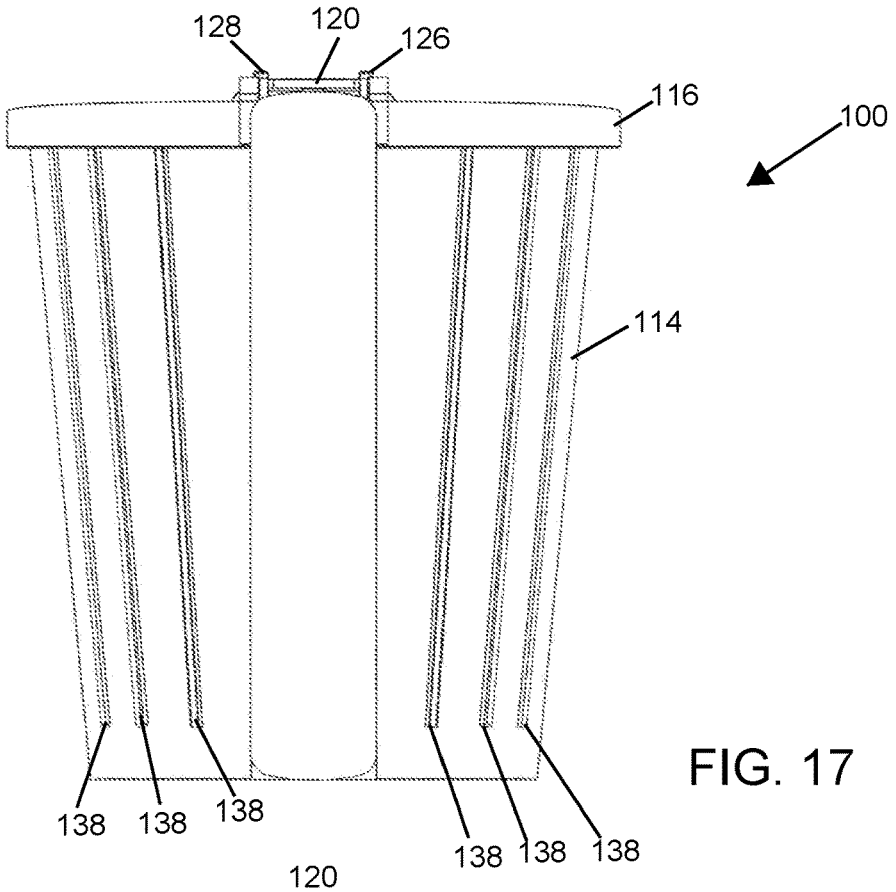
FIG. 17 is a rear view of the container of the second embodiment.
Figure 18:
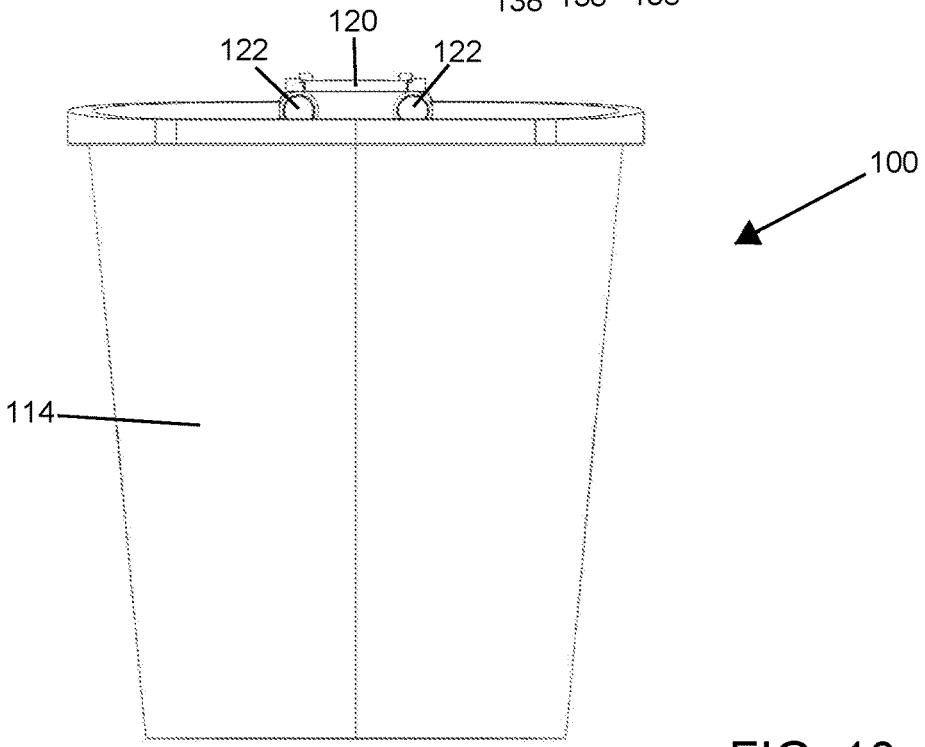
FIG. 18 is a front view of the container of the second embodiment.
Figure 19:
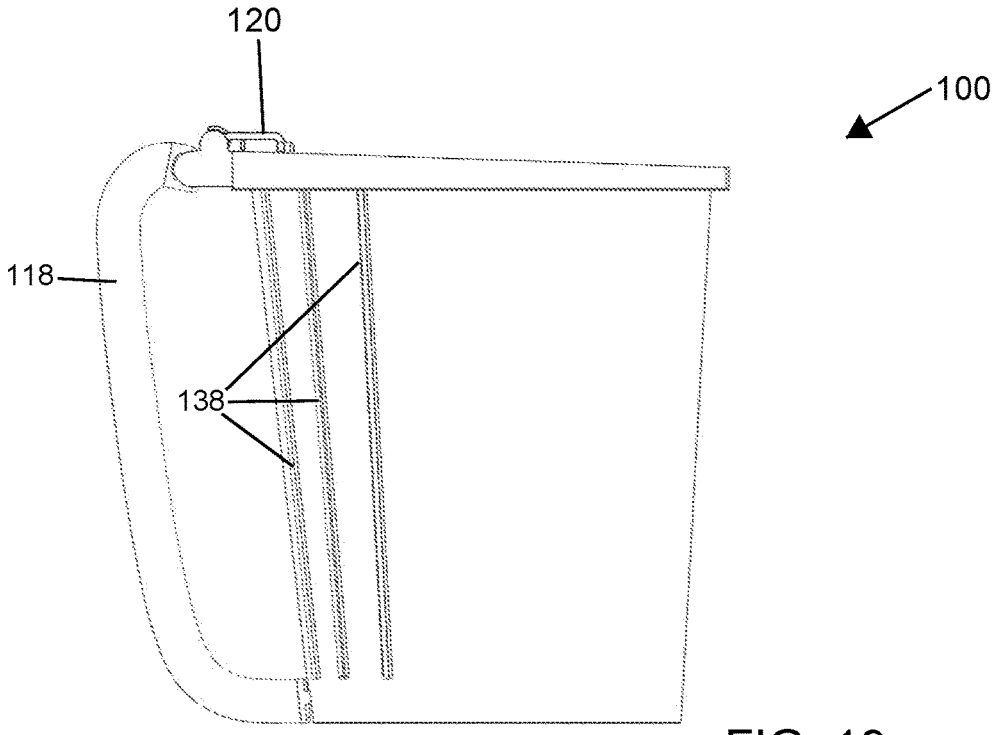
FIG. 19 is a first side view of the container of the second embodiment.
Figure 20:
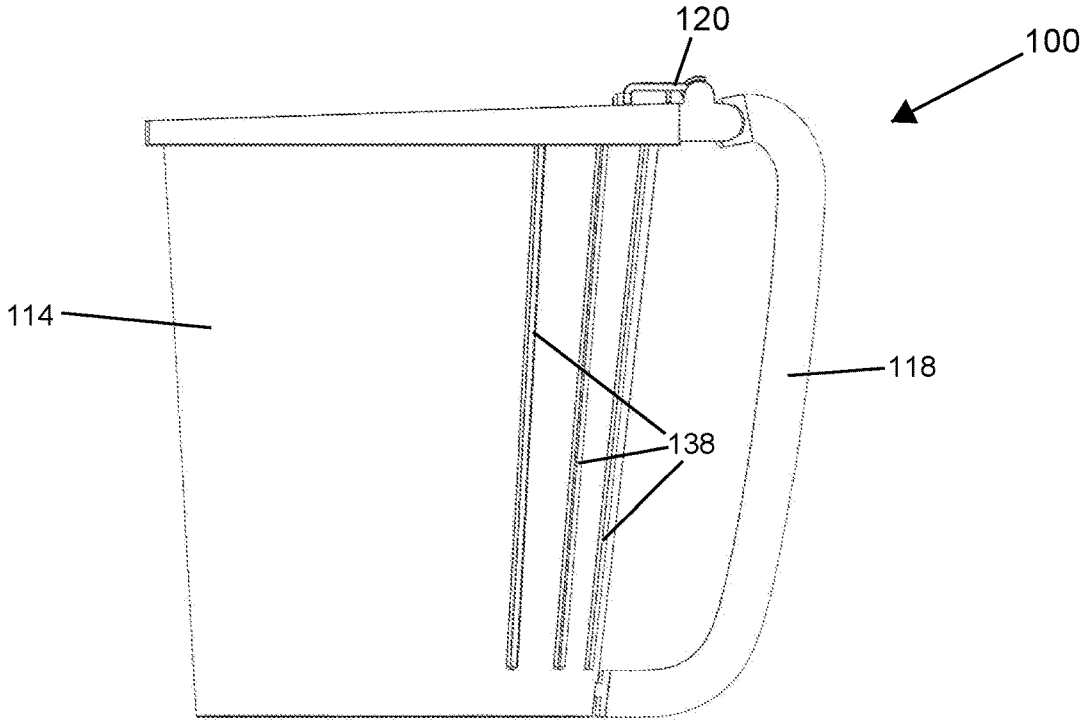
FIG. 20 is a second side view of the container of the second embodiment.
Figure 21:
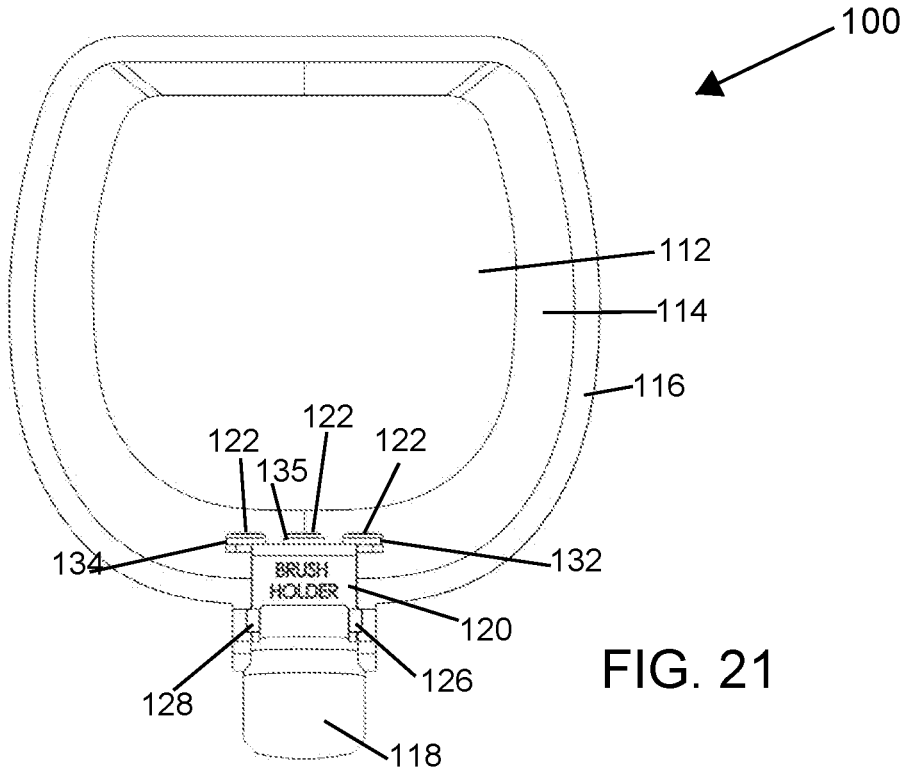
FIG. 21 is a top view of the container of the second embodiment.
Figure 22:
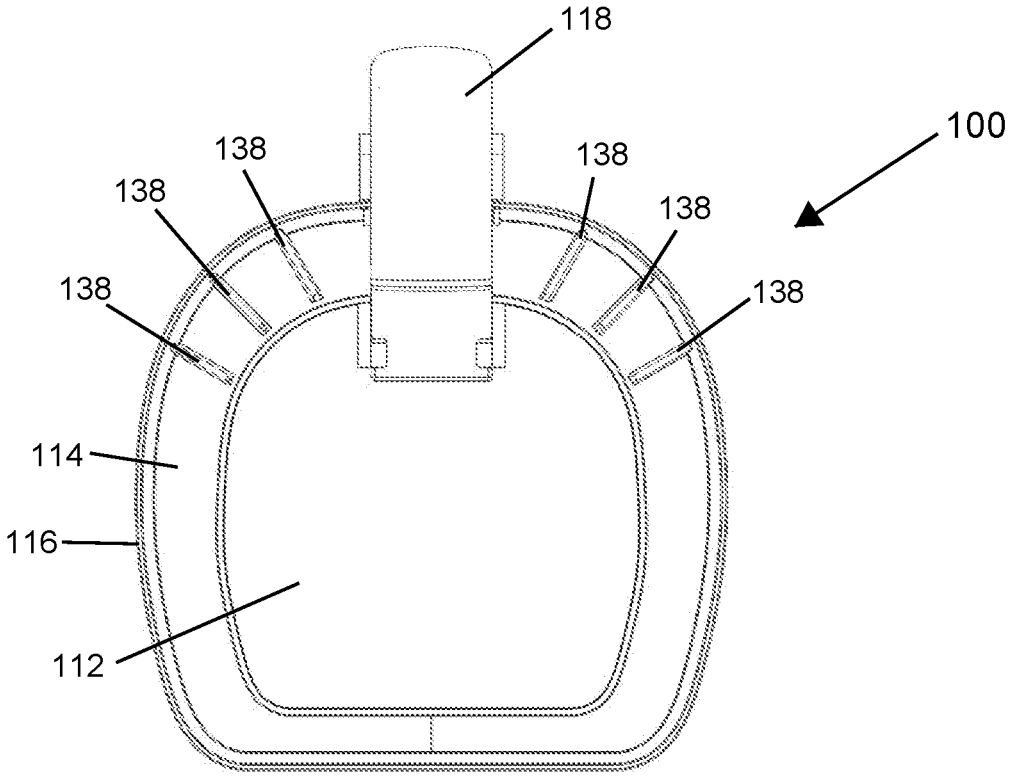
FIG. 22 is a bottom view of the container of the second embodiment.

Additionally, can be seen, for example, in the rear view of FIGS. 17 and 22, the container 100 includes a plurality of linearly extending strips 138 that extend outwardly from the sidewall 114 of the container 100 at a first location to the right of the handle 118 and at a second location to the left of the handle 18. Should a user slide their hand between the handle and container 100 instead of gripping the handle 118, the strips 138 aid the user in gripping the container 100. This is particularly helpful when a liquid may be drip onto the exterior of the container 100 and cause the container 100 to be slippery.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A paint container, comprising:

a base;

a sidewall extending from the base toward a rim delimiting the sidewall to form an interior space;

a handle, which extends substantially between and is delimited at a first end and a second end, rotatably fixed at the first end to the rim and extending toward and fixable at the second end to the base; and a bracket rotatably fixed to the rim and spaced entirely from the base, wherein the bracket is rotatable to partially extend within the interior space of the container in a first position and rotatable to extend above the rim in a second position, and wherein the bracket is configured to allow an object to be releasably fixed thereto within the interior space of the container and above the rim of the container.

2. The paint container of claim 1, wherein the bracket includes a first bracket member and a second bracket member that extends at an angle from the first bracket member.

3. The paint container of claim 2, wherein the bracket includes connecting elements that extend from a second end of the first member and at least one component that is configured to create a connection with another object fixed to the second member of the bracket.

4. The paint container of claim 3, wherein the at least one component fixed to the second bracket member is magnetic.

5. The paint container of claim 1, further comprising at least one magnet fixed to the bracket.

6. The paint container of claim 1, further comprising two magnets fixed to the bracket.

7. The paint container of claim 1, further comprising three magnets fixed to the bracket.

8. The paint container of claim 2, wherein a plurality of magnets are fixed to the second bracket member.

9. The paint container of claim 2, wherein the bracket includes at least one housing that extends from a first surface of the second bracket member and is configured to receive at least one magnet.

10. The paint container of claim 2, wherein the bracket includes a first housing, a second housing and a third housing that extend from a first surface of the second bracket member and are configured to receive at least one magnet.

11. The paint container of claim 1, further comprising a first extension extending from the rim and a second extension that is spaced from the first extension extending from the rim, and wherein the handle and the bracket are rotatably fixed between the first extension and the second extension.

12. The paint container of claim 11, wherein the first extension includes a first projection and a second projection extending toward the second extension and the second extension includes a first projection and a second projection extending toward the first extension.

13. The paint container of claim 12, wherein the handle includes openings and the second projection of the first extension and the second projection of the second extension are configured to be arranged to extend into the openings of the handle.

14. The paint container of claim 12, wherein the connecting element include a first leg and a second leg, said first leg and said second leg each having an opening therein that is configured to receive the first projection of the first extension and the first projection of the second extension.

15. The paint container of claim 1, wherein the object is a paint brush.

16. The paint container of claim 1, wherein the bracket is fixed only to the rim.

17. A paint container, comprising:

a base;

a sidewall extending from the base toward a rim delimiting the sidewall to form an interior space;

a first extension extending from the rim and a second extension that is spaced from the first extension extending from the rim a handle extending substantially between and delimited at a first end and a second end thereof, the first end of the handle being rotatably fixed to the rim and the second end of the handle extending toward and fixable at the base; and a bracket rotatably fixed to the rim, rotatable to partially extend within the interior space of the container and to extend above the rim and configured to allow an object to be releasably fixed thereto, wherein the handle and the bracket are rotatably fixed between the first extension and the second extension.

18. The paint container of claim 17, wherein the bracket includes a first bracket member and a second bracket member that extends at an angle from the first bracket member.

19. The paint container of claim 18, wherein the bracket includes connecting elements that extend from a second end of the first member and at least one component that is configured to create a connection with another object fixed to the second member of the bracket.

20. The paint container of claim 19, wherein the at least one component fixed to the second bracket member is magnetic.

* * * * *